United States Patent [19]

Lobach

[11] 4,208,748

[45] Jun. 24, 1980

[54] WATERBED MATTRESS

[75] Inventor: James L. Lobach, Broomfield, Colo.

[73] Assignee: Applied Vinyl Corporation, Denver, Colo.

[21] Appl. No.: 957,572

[22] Filed: Nov. 3, 1978

[51] Int. Cl.[2] ..... A47C 21/08

[52] U.S. Cl. ..... 5/451; 5/457

[58] Field of Search ..... 5/400, 420, 422, 441, 5/451, 452, 457, 458, 467, 468, 480; 128/376

[56] References Cited

U.S. PATENT DOCUMENTS

| | | | |
|---|---|---|---|
| 3,736,604 | 6/1973 | Carson, Jr. | 5/451 |
| 3,840,921 | 10/1974 | La Bianco | 5/458 |
| 4,055,867 | 11/1977 | Phillips | 158/376 |
| 4,145,780 | 3/1979 | Fogel | 5/458 |

*Primary Examiner*—Casmir A. Nunberg

*Attorney, Agent, or Firm*—Sheridan, Ross, Fields & McIntoh

[57] ABSTRACT

A fluid-containing mattress for reducing rapid fluid motion in the mattress is provided in one direction while permitting fluid flow in the opposite direction. The mattress comprises upper and lower sheets connected together in superposed relation. A number of thin, elongated members or strips are internally attached to the upper and lower sheets within the mattress. A strip attached to the upper sheet and a strip attached to the lower sheet are intermittently joined together at their longitudinal edge portions to form a one-way strip valve. A plurality of these strip valves are formed within the mattress to selectively direct fluid motion. Passages are also provided to bypass these strip valves so that the fluid eventually returns to all segments of the mattress and a uniform displacement of fluid is maintained in the mattress.

12 Claims, 12 Drawing Figures

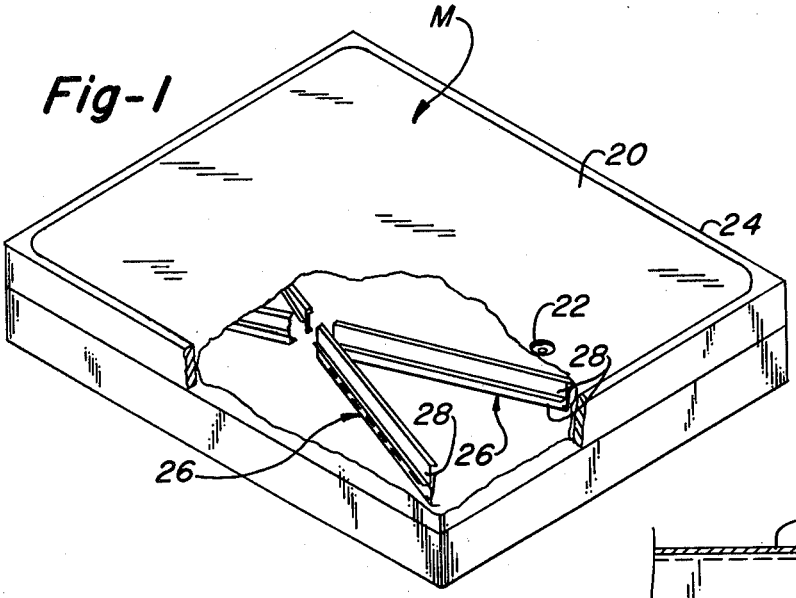
Fig-1
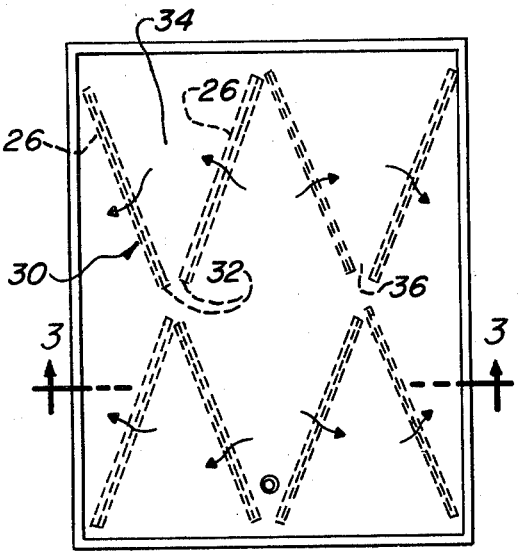
Fig-2
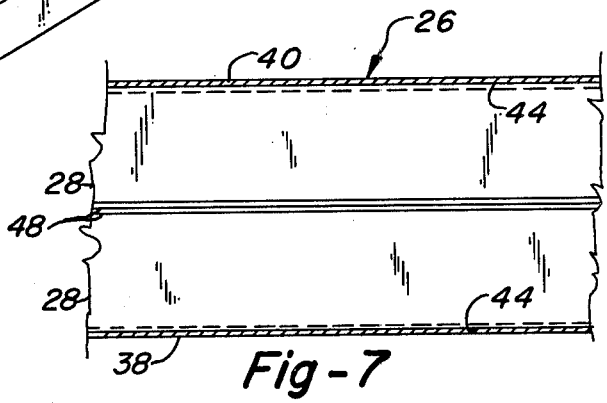
Fig-7
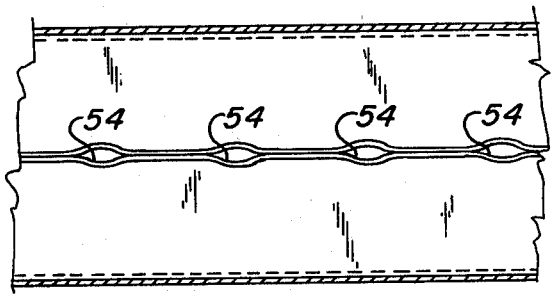
Fig-8
Fig-3
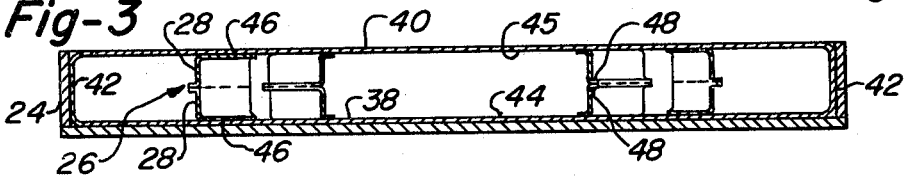
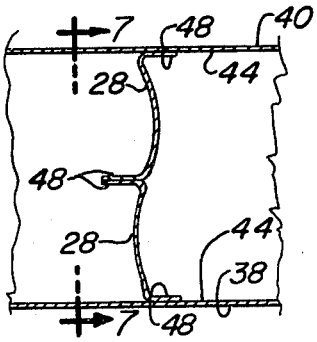
Fig-4
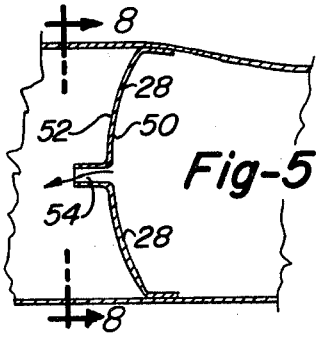
Fig-5
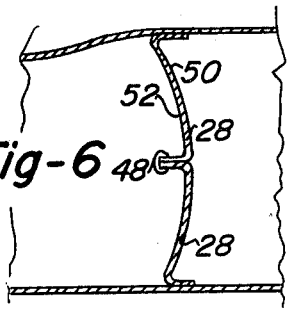
Fig-6

Fig-9
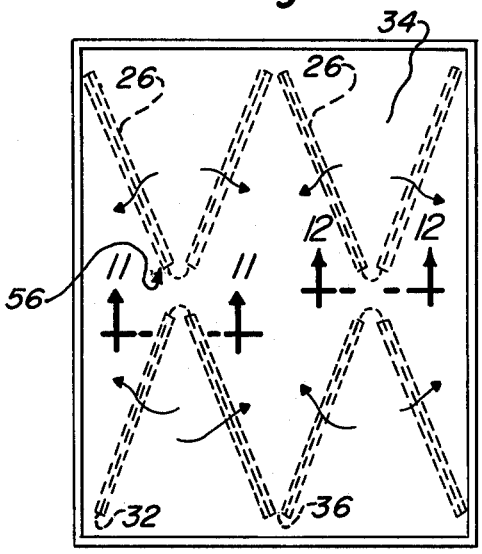
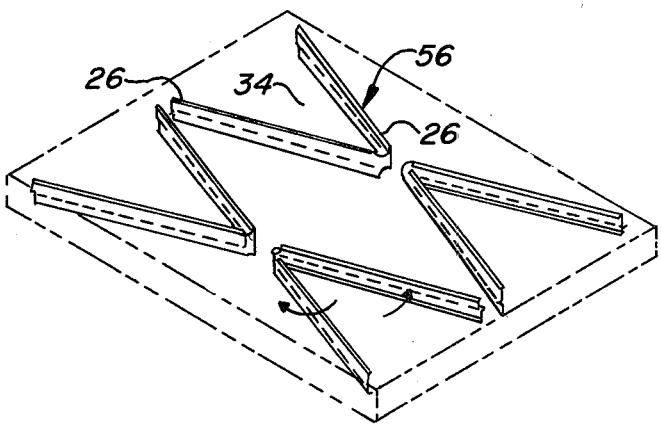
Fig-10
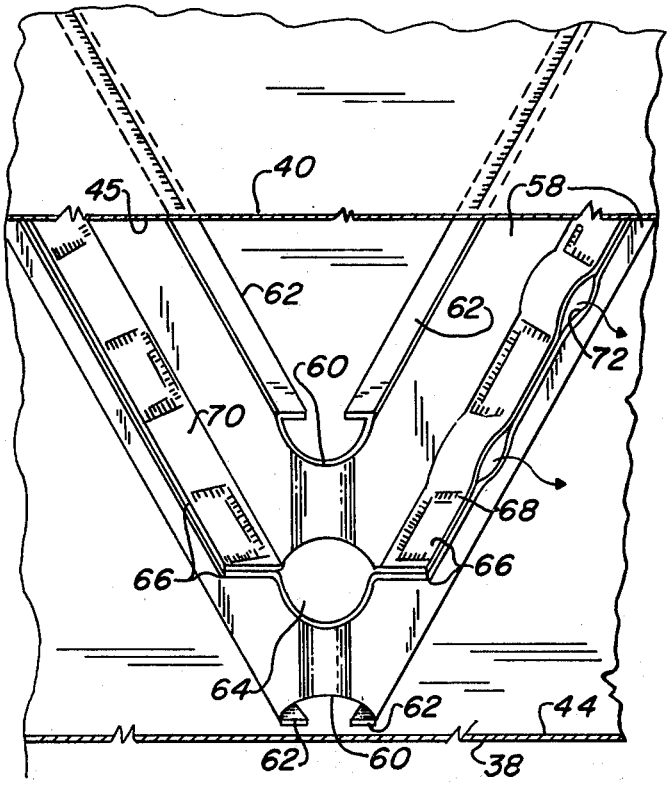
Fig-12
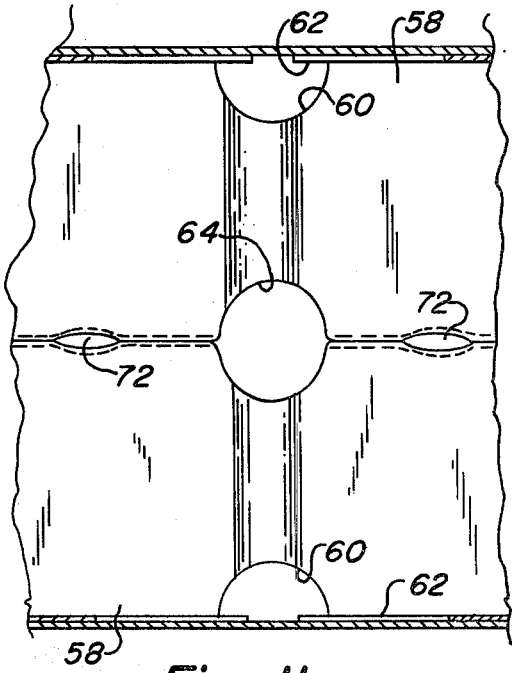
Fig-11

WATERBED MATTRESS

BACKGROUND OF THE INVENTION

1. Field of the Invention

This invention relates to a mattress for substantially reducing wave motion due to the fluid contained therein and, more particularly, to a mattress for permitting fluid flow in a first direction while hindering fluid flow in a second or opposite direction so that wave motion in the second direction, due to rapid displacement of fluid within the mattress, is reduced.

2. Description of the Prior Art

The water bed has recently achieved increasing popularity and widespread use among consumers. Nevertheless, a problem of fluid motion within the mattress has diminished the acceptance of the water bed by some potential customers. Therefore, to dampen this wave motion and thereby improve the quality of the product, a number of water bed structures have been developed. In U.S. Pat. No. 3,848,282 to Viesturs, a series of tie strips are disposed in parallel rows of differing lengths within a water-filled mattress to stablize water pressure within various regions of the mattress. In U.S. Pat. No. 4,080,676 to Calleance, an air chamber overlies a water chamber so that wave propagation is reduced in the water chamber and increased support is provided at the air chamber portion. In U.S. Pat. No. 3,778,852 to Penn, et al., a water-filled mattress is surrounded on its perimeter by an air chamber which is intended to dampen movement of the water in the mattress. Additionally, a water bed manufacturer, American National of Orange, California, uses baffles or water diverters sealed to the external surface of the mattress to restrict water motion. Unlike these flow reducing concepts, the mattress disclosed herein includes a number of one-way valves contained within the internal structure of the mattress for controlling water movement. This internal arrangement of valves minimizes fluid leaks since there are no additional external seams which are a likely source of fluid escape.

SUMMARY OF THE INVENTION

In accordance with the present invention, a mattress is provided together with a series of one-way valves connected internally to the structure of the mattress. These valves permit water or fluid flow in a first direction while reducing water motion in a second direction which is opposite to the first direction. A number of passages or spaces adjacent the ends of each of the valves allow the water to flow in the second direction so that water is slowly returned to all portions of the mattress to maintain comfortable flotation support for the user of the mattress.

More particularly, a water bladder or chamber is provided which includes a generally rectangular lower sheet and a generally rectangular upper sheet which is spaced from the lower sheet in superposed relation. Side sheets surround the periphery of the upper and lower sheets and connect the ends of these sheets together to provide a leak-proof mattress. A stoppered filler opening permits entry and removal of the fluid housed in the water chamber. A number of one-way strip valves are internally positioned within the mattress. Subjecting a first longitudinal side of one of the strip valves to water pressure greater than a second or opposite longitudinal side of the valve, substantially opens the valve so that water flows therethrough. Conversely, subjecting the second longitudinal side of the valve to a water pressure greater than the first or opposite longitudinal side of the valve, substantially closes the valve so that rapid water flow through the valve is impeded.

Each of these strip valves includes a pair of thin, elongated pieces or strips made of a flexible material such as vinyl. One of the strips is connected to a first or inner surface of the lower sheet. A second strip is connected to a first or inner surface of the upper sheet. The inner surfaces of both of these sheets are internal to the structure of the mattress so that the fluid contained within the mattress is contiguous with these inner surfaces. The strip attached to the upper sheet and the strip attached to the lower sheet are intermittently joined together at their longitudinal edge portions to form the one-way strip valve. The longitudinal edge portions of the strips, when intermittently joined together, are in contiguous, superposed relation so that the longitudinal edge portions extend outwardly from the strip valve. These strip valves are arranged within the mattress such that two strip valves linearly diverge from each other toward the side sheets of the mattress so that a generally V-shaped pattern is formed. This V-shaped pattern formed by two strip valves within the mattress also defines a V-shaped water section contained between the two strip valves. When the longitudinal edge portions of the strips are intermittently joined so that they extend outwardly away from the V-shaped water section, the rate of water movement from sections of the mattress outside the v-shaped water section into the V-shaped section, through the strip valve, is substantially reduced. Additionally, passages or spaces are provided adjacent lateral edges of the strip valves to assure return of the water to all segments of the mattress.

From the foregoing, the advantages of the invention are readily apparent. Rapid displacement of water within the mattress due to the application of a force or weight thereto is substantially alleviated. Rebound wave motion from the side portions of the mattress which is supported by a frame is also reduced. The one-way valve arrangement is completely internal to the mattress structure, thereby offering no additional external fluid leak sources. Furthermore, ease of manufacture is enhanced because of the relative simplicity of structure.

Additional advantages of this invention will become apparent from the description which follows, taken in conjunction with the accompanying drawings.

BRIEF DESCRIPTION OF THE DRAWINGS

FIG. 1 is a perspective view of the mattress supported by a surrounding frame with a portion of the mattress cut away to expose the one-way strip valve of this invention;

FIG. 2 is a top plan view of the mattress showing one embodiment of the valves in a V-shaped pattern;

FIG. 3 is an enlarged longitudinal cross-section, taken along lines 3—3 of FIG. 2, showing the strips joined together to form the one-way strip valve;

FIG. 4 is a fragmentary, greatly enlarged view of two of the strips joined together when there is substantially equal fluid pressure on both longitudinal sides of the valve;

FIG. 5 is a fragmentary, greatly enlarged view, similar to FIG. 4, but showing the strip valve opening when there is greater fluid pressure against the first longitudinal side of the valve;

FIG. 6 is a fragmentary, greatly enlarged view, similar to FIG. 5, but showing a substantial closing of the strip valve when there is greater fluid pressure against the second longitudinal side of the valve;

FIG. 7 is a fragmentary, greatly enlarged vertical cross-section taken along lines 7—7 of FIG. 4, showing two strips intermittently joined together;

FIG. 8 is a fragmentary, greatly enlarged vertical cross-section, taken along lines 8—8 of FIG. 5, showing the openings between the intermittently connected strips;

FIG. 9 is a top plan view, similar to FIG. 2, but showing an alternative embodiment in which strips of the strip valves are connected to form a V-shaped pattern;

FIG. 10 is a perspective view showing the features of the strip valve arrangement of FIG. 9;

FIG. 11 is a fragmentary, greatly enlarged longitudinal cross-section, taken along lines 11—11 of FIG. 9, showing further details of the strip valve arrangement; and FIG. 12 is a fragmentary, greatly enlarged longitudinal cross-section, taken along lines 12—12 of FIG. 9, showing additional details of the strip valve arrangement.

DESCRIPTION OF THE PREFERRED EMBODIMENTS

In accordance with this invention, a water bed mattress M is seen in FIG. 1 including a water chamber or bladder 20 having a stoppered filler opening 22. The mattress M is surrounded by a frame 24 which provides support to the mattress M and helps to maintain the mattress in a generally rectangular configuration when the mattress M is filled with water or other fluids. Mattress M further includes a number of one-way strip valves 26, which permit fluid or water to flow in one direction through the valves, but substantially reduce water flow in the opposite direction. Strip valves 26 are preferably constructed of vinyl and each valve includes a pair of strips 28. Strip valves 26 are completely contained within chamber 20 and may be arranged in any manner therein to impede water motion. Lateral and longitudinal movement of water within the chamber 20 results whenever weight or force is applied to chamber 20 after it has been filled with water. This weight on the water-filled chamber 20 usually is due to the weight of the user of the water bed. The strip valves 26 substantially lessen the rapid displacement of water whenever a user lies on the chamber 20. In addition, strip valves 26 can act to reduce water movement in the direction of the center of the water bed by hindering water flow resulting from the rebounding of the water as it strikes the portion of chamber 20 adjacent the frame 24. These advantages of mattress M are more clearly visualized in FIG. 2 which depicts a preferred configuration of the strip valves 26. Two of the strip valves 26 are arranged in a V-shaped pattern 30 and there are four V-shaped strip valve patterns 30 contained in the chamber 20. To form the V-shape, lateral edges 32 of a first strip valve 26 are spaced from the lateral edges 32 of a second strip valve 26 near the longitudinal mid portion of the chamber 20. The two strip valves 26 linearly diverge in a direction along the longitudinal axis of the mattress M toward the frame 24 resulting in an increasing space between the first and second strip valves 26. This configuration is repeated in all four quadrants of the generally rectangular-shaped chamber 20 such that a symmetrical disposition of V-shaped valve patterns 30 is formed about the longitudinal and horizontal axes of the chamber 20.

The arrows of FIG. 2 indicate the allowable direction of water flow through the strip valves 26. As can be seen, water can move from the center portion of the chamber 20 through the strip valves 26 into V-shaped water section 34. Water then may flow from V-shaped section 34 into another section of the chamber 20 adjacent the frame 24. Water flow in the opposite direction, towards the center portion of the water chamber 20, is substantially reduced by the strip valves 26 so that a user of the water bed, lying on the center portion of the chamber 20, is not subject to the full force of the water rebounding within the chamber 20 from the frame 24. As also seen in FIG. 2, there are passages or spaces 36 adjacent the lateral edges 32 of the strip valves 26. Passages 36 allow the water to bypass the strip valves 26 and slowly return water to all sections or portions of the chamber 20.

The construction of strip valves 26 within chamber 20 is illustrated in FIG. 3. Chamber 20 comprises a rectangular lower sheet 38 and a rectangular upper sheet 40, dimensionally equal and in superposed relation with lower sheet 38, and four side sheets 42 generally perpendicular to the upper and lower sheets and connected therebetween to provide a rectangular-shaped, leak-proof water chamber 20. Lower sheet 38 has an inner or first surface 44 while upper sheet 40 has an inner or first surface 45, both of which are contiguous with the water or fluid contained within chamber 20. To form strip valve 26, a first strip 28 is attached at its longitudinal seam portion 46 to the inner surface 44 of the lower sheet 38. A second strip 28, equal dimensionally to first strip 28, is attached at its seam portion 46 to the inner surface 45 of upper sheet 40. Strips 28 are preferably made of vinyl and may be conveniently connected to the upper and lower sheet inner surfaces by a heat weld. Thus, there is no additional seam external to the chamber 20 because of the inclusion of the strips 28 within the chamber 20. The two strips 28, attached to the upper and lower sheets of chamber 20, are then intermittently connected along their longitudinal edge portions 48 at a distance generally midway between the upper and lower sheets, as seen in FIG. 4, in contiguous parallel relation so that their edge portions 48 extend outwardly from their respective strips 28. FIG. 7 also shows the intermittent connection of the edge portions 48 of the two strips 28 to form the one-way strip valve 26. This intermittent connection adequately provides contact between the two strips 28 so that water flow through the strip valve 26 is substantially stopped in one direction along the entire length of the strip valve 26.

The functioning of strip valves 26 is shown in FIG. 5. When fluid or water pressure is exerted against a first longitudinal side 50 of strip valve 26, which pressure is greater than that against the opposite or second longitudinal side 52 of strip valve 26, valve space 54 located between the intermittent connections of the strip valve longitudinal edge portions 48 opens and permits water to flow therethrough. The water moves in the direction in which the edge portions 48 outwardly extend from the strips 28. FIG. 8 depicts a plurality of valve spaces 54 located along the entire length of the strip valve 26 which open between the intermittent connections of the longitudinal edge portions 48 of the strips 28 to permit water flow through the strip valve 26. Conversely, as depicted in FIG. 6, greater water pressure against the second longitudinal side 52 of strip valve 26, in a direction opposite to that in which edge portions 48 extend, results in a bowing of the strips 28 such that valve spaces 54 are substantially closed to hinder water movement in that direction through the strip valves 26.

Another embodiment of the invention, similar to the valve arrangement of FIG. 2, but permitting a different direction of water flow, is illustrated in FIGS. 9 and 10. Rather than substantially dissipating water motion in the direction towards the longitudinal center portion of the mattress M as accomplished by the valve arrangement of FIG. 2, rapid water flow is reduced from the center portion into the V-shaped water sections 34. Another distinguishing feature of this embodiment is the utilization of a single, integral V-shaped strip valve 56. Unlike the two spaced strip valves 26 of FIG. 2 which together form a V-shaped strip valve pattern 30, strip valve 56 can be formed into a V-shaped pattern. Each V-shaped strip valve 56 includes a pair of double strips 58. Double strip 58 is formed by integrally connecting two strips 28 together at their lateral edge portions 32. Double strip 58 includes a pair of arcuate-shaped openings 60. One arcuate opening 60 is formed at the longitudinal seam portion 62 near the longitudinal mid portion of double strip 58 while the second arcuate opening 60 is formed at the longitudinal edge portion 66 and is axially aligned with the first arcuate opening 60. As seen in FIG. 11, the intermittent connection of a pair of double strips 58 also forms the generally circular aperture 64 at the longitudinal mid portion of the double strips 58. Aperture 64 is formed by two of the arcuate-shaped openings 60 joined together when two double strips 58 are intermittently connected along their longitudinal edge portions 66. The arcuate openings 60 and circular aperture 64 permit air bubble and water flow therethrough and provide a return path for fluid into V-shaped water section 34.

As best seen in FIG. 12, one double strip 58 is attached along the entire length of its seam portion 62 to the inner or first surface 44 of the lower sheet 38. Similarly, a second double strip 58 is attached along the entire length of its seam portion 62 to the inner surface 45 of upper sheet 40. The two double strips are intermittently joined together at their longitudinal edge portions 66 so that edge portions 66 are substantially equidistantly positioned from upper sheet 40 and lower sheet 38. The contiguous over-lapping edge portions 66 extend outwardly from the V-shaped strip valve 56 in a direction away from V-shaped water section 34. Edge portions 66 are intermittently connected along sealed paths 68 by which closed segments 70 and spreadable portions 72 are formed. The arrows of FIG. 12 indicate that, when there is greater water pressure in a V-shaped water section 34 than outside of water section 34, spreadable portions 72 open thereby permitting water flow out of the V-shaped water section 34. Similar to the valve arrangement of FIG. 2, spaces or passages 36 are provided adjacent the lateral edges of the valves 56 so that the water may bypass the V-shaped strip valves 56 and move or return into the V-shaped water sections 34 so that uniform water displacement within the chamber 20 is assured when the water pressure in water sections 34 is substantially the same as the water pressure outside.

From the foregoing, the advantages of this invention are readily apparent. A water bed mattress is provided which substantially reduces water motion, in a preselected direction, due to the weight of a user on the mattress. This lessening of the rate of water displacement in the mattress is accomplished by a series of one-way valves arranged within the chamber of the mattress. The valves are sealingly positioned within the interior of the mattress and have intermittent openings to permit water flow in one direction. The water may be returned to all sections of the mattress through passages which bypass the one-way valve arrangement.

The invention has been described in detail with particular reference to a plurality of embodiments thereof, but it will be understood that variations and modifications can be effected within the spirit and scope of this invention.

What is claimed is:

1. A fluid-containing mattress which controls fluid motion resulting from the weight of a user upon the fluid-filled mattress, said mattress comprising:
   chamber means for containing the fluid;
   a one-way valve connected within said chamber means to substantially reduce fluid flow in a first direction through said valve while permitting fluid flow in a second direction, opposite to said first direction, through said valve; and
   bypass means within said chamber means for allowing fluid to flow in said first direction to circumvent said valve and return the fluid to all portions of said chamber means.

2. The mattress, as claimed in claim 1, wherein:
   said valve includes a strip having a seam portion and a longitudinal edge portion, said seam portion is connected to said chamber means along the entire length of said seam portion to hold the strip in the chamber means and said longitudinal edge portion is intermittently connected to said chamber means so that the flow of fluid in said first direction through said strip is substantially reduced.

3. The mattress, as claimed in claim 1, wherein said chamber means includes:
   a lower sheet having a first surface;
   an upper sheet having a first surface and being in superposed relation with said lower sheet;
   side sheets joining the periphery of said upper and lower sheets together to form a completely sealed unit for containing fluid; and
   means for closably receiving the fluid into said chamber means.

4. The mattress, as claimed in claim 3, wherein:
   said valve includes a first and second strip, each of said strips has a seam portion, a longitudinal edge portion, and a pair of lateral edge portions, said seam portions of said first and second strips being connected to said first surface of said lower and upper sheets, respectively, and said longitudinal edge portions of said first and second strips being intermittently connected to form a strip valve so that fluid flows in a first direction through said intermittently connected strips while fluid motion is substantially reduced in the opposite direction therethrough.

5. The mattress, as claimed in claim 4, wherein:
   said longitudinal edge portions of said first and second strips are connected in superposed, contiguous relation and said edge portions extend from said strips in a direction away from the center portion of said mattress so that fluid flow through said strip valve in the direction of the center of said mattress is substantially reduced.

6. The mattress, as claimed in claim 4, wherein said strip includes:

a first arcuate opening formed in said longitudinal edge portion and positioned generally at the longitudinal mid portion of said strip;

a second arcuate opening formed in said seam portion and axially aligned with said first arcuate opening so that the intermittent connection of said first and second strips forms a generally circular aperture through which fluid moves in said mattress.

7. The mattress, as claimed in claim 4, further including:

a plurality of strip valves, each of said strip valves being spatially disposed from each other and extending toward and being positioned intermediate of said side sheets of said chamber means to define a plurality of fluid sections in said chamber means.

8. The mattress, as claimed in claim 7, wherein:

said bypass means includes a plurality of passages, one of said passages being adjacent each of said lateral edge portions of said strips.

9. The mattress, as claimed in claim 4, wherein:

a first strip valve and a second strip valve are arranged within said chamber means in a V-shaped strip valve pattern.

10. The mattress, as claimed in claim 9, wherein:

said first strip valve is connected to said second strip valve to form the V-shaped strip valve pattern.

11. The mattress, as claimed in claim 9, wherein:

said V-shaped strip valve pattern is arranged in each of the four quadrants of said chamber means so that four V-shaped strip valve patterns are substantially symmetrically disposed about the longitudinal and horizontal axes of said chamber means.

12. A fluid-containing mattress which controls fluid motion resulting from the weight of a user upon the fluid-filled mattress, said mattress comprising:

a lower sheet having a first surface contiguous with the fluid;

an upper sheet having a first surface contiguous with the fluid and in superposed relation with the said lower sheet;

a plurality of side sheets generally perpendicular to said upper and lower sheets and joining the periphery of said upper and lower sheets together to form an integral fluid-containing unit;

a stoppered filler opening for receiving fluid into the mattress and discharging fluid from the mattress;

a plurality of first strips, each of said strips having a longitudinal edge portion and a seam portion, wherein each of said seam portions is sealingly connected to said first surface of said lower sheet in a V-shaped pattern;

a plurality of second strips, each of said second strips having a longitudinal edge portion and a seam portion, wherein each of said seam portions is sealingly connected to said first surface of said upper sheet in a V-shaped pattern, each of said longitudinal edge portions of said second strips is intermittently connected to one of said longitudinal edge portions of said first strip in superposed contiguous relation to form a one-way strip valve and define a V-shaped fluid section within the mattress, said longitudinal edge portions extend outwardly from said strip valve and in a direction away from said V-shaped fluid section to substantially reduce fluid motion into said V-shaped fluid section through said intermittently connected first and second strips;

a plurality of passages, one of said passages being adjacent each of said strip valves to provide a path for fluid into said V-shaped fluid sections.

* * * * *